US006981474B2

(12) United States Patent
Frommelt et al.

(10) Patent No.: US 6,981,474 B2
(45) Date of Patent: Jan. 3, 2006

(54) SETTING TOOL

(75) Inventors: Markus Frommelt, Schaan (LI); Robert Jakob, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/932,367

(22) Filed: Sep. 1, 2004

(65) Prior Publication Data

US 2005/0051594 A1 Mar. 10, 2005

(30) Foreign Application Priority Data

Sep. 5, 2003 (DE) ..... 103 41 385

(51) Int. Cl.
*F02B 71/00* (2006.01)

(52) U.S. Cl. ..... 123/46 R; 227/10; 227/130

(58) Field of Classification Search ..... 123/46 R, 123/46 SC; 227/10, 130; 173/210, 211

See application file for complete search history.

(56) References Cited

U.S. PATENT DOCUMENTS

| | | | | |
|---|---|---|---|---|
| 5,056,701 | A * | 10/1991 | Bereiter | 227/10 |
| 6,220,495 | B1 * | 4/2001 | Jakob | 227/10 |
| 6,536,647 | B2 * | 3/2003 | Buchel et al. | 227/10 |
| 6,857,548 | B1 * | 2/2005 | Clark | 227/130 |

* cited by examiner

*Primary Examiner*—Mahmoud Gimie
(74) *Attorney, Agent, or Firm*—Abelman, Frayne & Schwab

(57) ABSTRACT

A setting tool for driving fastening elements and including a setting piston (20) axially displaceably arranged in the hollow chamber (14) of a piston guide (13), and a piston stop device (30) for the setting piston (20), arranged in setting direction end region of the hollow chamber (14) and having a damping element (31) supported against a stop (15), and a stop member (32) adjoining the damping element (31) in a direction of the hollow chamber (14) and operationally connectable with the piston band (22), and having a cylindrical bushing (33) for the piston stem (21), with the bushing (33) having an inner diameter ($D_S$) that amounts to from 70% to 90% of a size of the maximal outer diameter ($D_B$) of the prison band that has a conical surface engageable with the inner surface of the bushing.

5 Claims, 3 Drawing Sheets

20
$D_B$
22
24
35
13
32
33
30
34
36
17
16
31
$D_S$
15
12
40
21

SETTING TOOL

BACKGROUND OF THE INVENTION

1. Field of the Invention

The present invention relates to a setting tool for driving in fastening elements and including a piston guide having a hollow chamber, a setting piston axially displaceably arranged in the hollow chamber of the piston guide and having a piston head, a piston stem, a piston band, and a piston stop device for the setting piston and arranged in a setting direction end region of the hollow chamber, with the piston stop device having a damping element supported against a stop, and a stop member adjoining the damping element in the direction of the hollow chamber and operationally connectable with the piston band.

2. Description of the Prior Art

Setting tools of the above-described type are driven with solid, gaseous, or fluid fuels or with compressed air. In combustion-driven setting tools, the setting piston is driven by combustion gases. With these setting tools, fastening elements, such as, e.g., nails or bolts are driven in constructional components.

German Publication DE 3930592A1 discloses a setting tool in which a piston is guided in a piston guide that is axially displaceably arranged in a sleeve-shaped housing. For effecting a setting process, the setting tool should be pressed against a constructional component to press the piston guide into the housing. For reduction of the piston energy at false set-ups or when the piston is driven with an excessive energy forward into the piston guide, there is provided in an end region of the piston guide, an elastic annular member which intercepts the piston.

A drawback of this setting tool consists in that when the wear of the elastic annular member is too large and cannot be recognized, expensive tool components can be damaged. Further, the piston band which strikes the annular member should have as a large diameter as possible to prevent a premature destruction of the annular member. This increases the tool weight. For high-energy tool (above about 350J), the elastic annular member is unsuitable because the piston penetrates deeply into the elastic annular member, causing a strong wear of the rubber which leads to damage of the tool.

German Publication DE 19947464A1, from which the present invention proceeds, discloses a setting tool in which a sleeve-shaped thrust member that acts as a stop for the piston, is supported via an elastic annular buffer against a bolt guide. The thrust member has a conical opening expanding toward the piston band, with the diameter of the piston band being substantially larger than the inner diameter of the opening of the thrust member. During a stop process with the thrust member, the lower surface of the piston band engages an annual surface of the thrust member surrounding the opening.

A drawback of the setting tool of DE 19947464A1 is a high mass of the piston because of the large piston band diameter. Another drawback consists in that the allowable amount of the wear of the thrust member or of the buffer cannot be recognized by the user, which can lead to damage of tool components.

U.S. Pat. No. 4,828,003 discloses a setting tool in which between the piston guide and the bolt guide, there are arranged one after another a rigid ring and an elastic ring. In the elastic ring, a further rigid ring is arranged that limits the stroke of the first rigid ring. The first rigid ring has a bushing conically narrowing in the setting direction for the piston stem. The piston band surface of the setting piston adjacent to the first rigid ring, has a conical profile, and the conical profile of the piston band surface and the conical surface of the bushing are complementary to each other.

A drawback of the setting tool of U.S. Pat. No. 4,828,003 consists in that the allowable amount of the first ring wear cannot be recognized by the user, which again can lead to damage of the tool components.

An object of the present invention is to so modify the setting tool of the above-described type that the drawbacks of the prior art tools are eliminated and the damage of the tool components is prevented.

Another object of the present invention it to so modify the setting tool that wear of the piston stop or braking device above an allowable amount is recognized by the user.

SUMMARY OF THE INVENTION

These and other objects of the present invention, which will become apparent hereinafter are achieved by providing in a tool of the above described type a stop member having a cylindrical bushing for the piston stem having an inner diameter that amounts to from 70% to 90% of the size of the maximal outer diameter of the piston band that has a conical surface engageable with an inner surface of the cylindrical bushing. According to an advantageous embodiment of the present invention, the inner diameter of the cylindrical bushing amounts to from 75% to 85% of the maximal outer diameter of the piston band. The geometrical relationships of the elements of the inventive piston stop device and the piston band provide for a plastic deformation of the stop member, which can be formed as a sleeve-shaped body or as a thrust member, with each improper use. With each improper or faulty use, the setting piston with its band penetrates deeper in the cylindrical bushing of the stop member. When the piston penetrates in the stop member by a predetermined portion of its axial length, the piston becomes jammed in the stop member. The user recognizes that the piston became non-operative and, thus, recognizes that the piston, together with the piston stop jammed on the piston stem, needs to be removed and replaced.

This prevents damage of the other component of the setting tool such as, e.g., the piston guide or the bolt guide.

Advantageously, both the stop member and at least the piston band or the entire piston are formed of metal, which insures an economical manufacturing of this elements. Further, by using certain metals, a predetermined hardness of respective elements can be achieved.

Advantageously, the piston band has a hardness from 50 to 60 HRC, and the stop member has a hardness in a range from 50% to 70% of the hardness of the piston band. However, the upper limit of the stop member should not exceed 38 HRC. With such relationship of respective hardness, a predetermined deformation of the stop member by the piston band is obtained because the relatively hard piston band can comparatively easy deform the relatively soft stop member when the piston stop device stops or brakes the setting piston as a result of faulty use.

It is further advantageous when the stop member has a circumferential recess formed in its outer surface and having an arcuate or arc-shaped profile. In the region of the circumferential recess, there is provided, in the stop member wall, a weakness zone that functions as a quasi hinge. Thus, when the setting piston strikes the stop member, the section of the stop member adjacent to the hollow space can be bent-up around this hinge, so that the piston can penetrate into the cylindrical bushing of the stop member by a certain amount.

It is further advantageous when the ratio of the mass of the setting piston to the mass of the stop member amounts to from 3:1 to 5:1 and is, preferably, 4:1. This ratio of the masses of the setting piston and the stop member also facilitates the desired deformation of the stop member in case of a faulty usage.

It is also advantageous when a bolt guide adjoining the piston guide at a setting direction end of the piston guide has regionwise, a sleeve-shaped section surrounding, at least partially, the stop member and having an inner surface conically tapering in a setting direction of the setting tool.

During a faulty use, a stop provided on the stop member can engage the tapering inner surface of the bolt guide, with the stop of the stop member being deformed as a result of engagement with the inner surface of the bolt guide which is formed, preferably, of a hard material. Thus, a further energy reduction of the excessive setting energy takes places at the interface between the bolt guide and the stop member.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
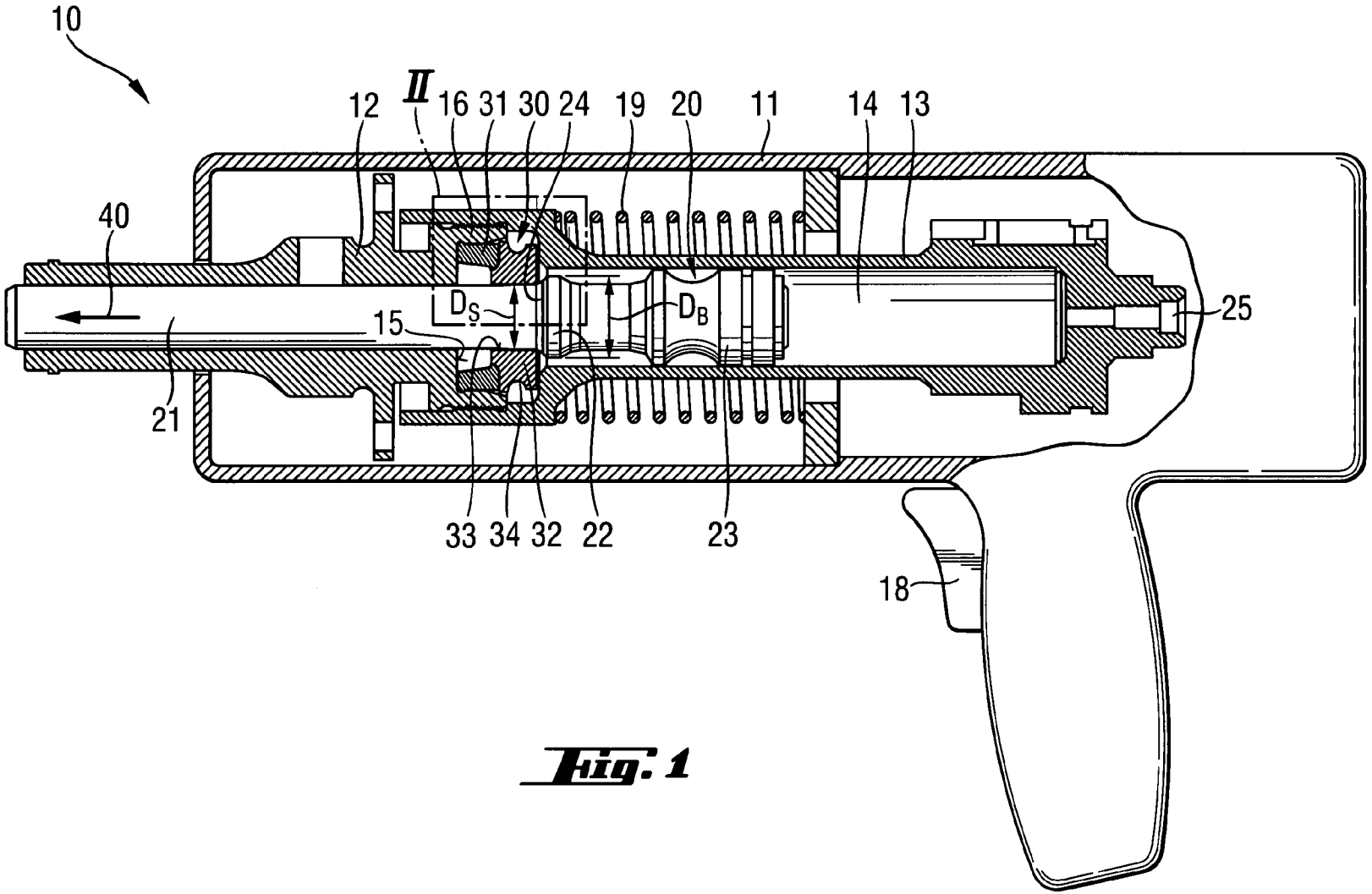
FIG. 1 a partially cross-sectional side view of a setting tool according to the present invention with a piston stop device.
Figure 2:
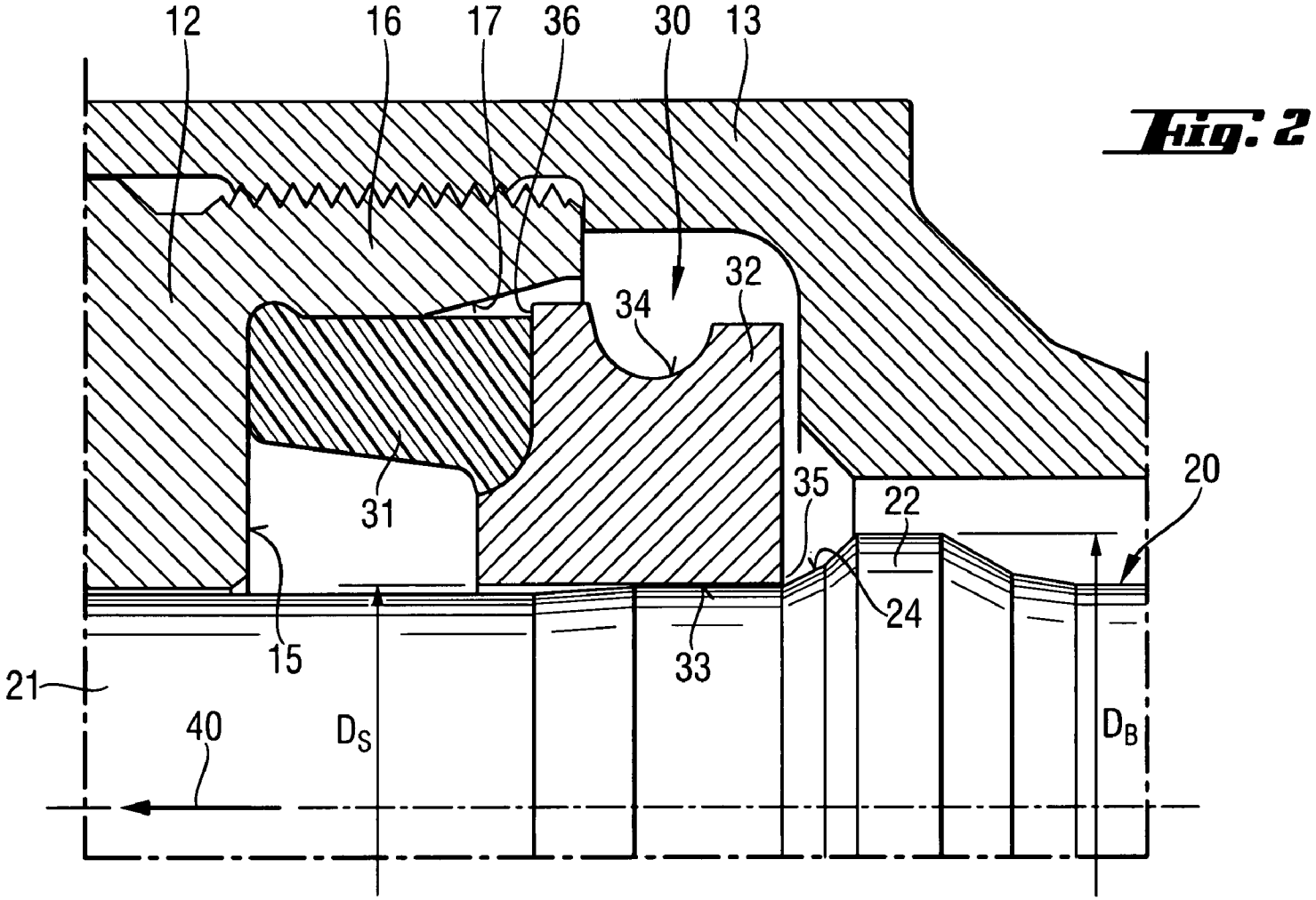
FIG. 2 a cross-sectional view of a detail of the setting tool and designated with a reference sign II in FIG. 1, with the piston stop device having no wear.

FIGS. 1–2 show a hand-held setting tool 10 according to the present invention with a piston stop device 30 that has not yet been subjected to any wear. The setting tool 10 has a one-or multi-part housing 11, a piston guide 13 arranged in the housing 11, and a setting piston 20 displaceably arranged in hollow chamber 14 of the piston guide 13. The setting piston 20 is driven by a propellant or by products of its reaction, e.g., by combustion gases, etc. The setting piston 20 has a piston stem 21 and a piston head 23 provided at the rear, in the setting direction 40, end of the stem 21. Spaced from the piston head 23, there is provided, on the stem 21, a band 22. The piston band 22 has a conical surface 24 arranged in the direction of the piston stop device 30. Alternatively to the arrangement shown in the drawings, the band 22 can be arranged in the setting direction region of the piston head 23. The piston guide 13 is displaceably arranged in the curve-shaped housing 11 and is supported against a spring 19. At the end of the piston guide 13 facing in the direction opposite the setting direction 40, there is arranged a cartridge socket 25 for receiving a propellant, e.g., in form of a catridge, pellet, or blister.

The setting process can only then be effected with the setting tool 10 when a bolt guide 12, which is located in front of the piston guide 13, is pressed against an object, not shown. For actuating the setting tool 10, there is provided thereon an actuation switch 18.

At the end of the piston guide 13 adjacent to the bolt guide 12, there is provided the piston stop device 30. The piston stop device 30 is supported against a stop 15 which is formed as a bottom of a sleeve-shaped section 16 of the bolt guide 12. The piston device 30 has a damping element 31 formed as an elastomeric ring, and a stop member 22 formed as a metal sleeve that serves as a thrust member. The damping element 31 is molded on the stop member 22, so that the stop member 32 is supported indirectly and elastically against the stop 15 via the damping element 31.

At the end surface of the stop member 32 remote from the bolt guide, there is provided a stop 35 against which the setting piston 20 can bounce, so that the piston stop device 30 stops or brakes the movement of the setting piston 20 when it displaces, because of a faulty set-up or a too strong propellant, forward up to the stop member 32. In the stop member 32, a bushing 33 is arranged through which the piston stem 21 is displaceable. The diameter $D_S$ of the cylindrical bushing 33 lies in a range from 70% to 90%, preferably in the range from 75% to 85% of the diameter $D_B$ of the piston band 22. The hardness of the stop member 32, which is formed, e.g., of steel, lies, ideally, in a range from 50% to 70% of the hardness of the piston band 22 that has a hardness equal or greater than 50 HRC (Rockwell hardness). Advantageously, however, the hardness of the stop member 32 should not be above approximately 38 HRC, which makes the stop member 32 "soft", so that the stop member can be deformed by being striked by piston band 22 of the setting piston 20, in case of a faulty set-up, or by an excessive energy. When the piston band 22 strikes the stop member 32, it is displaced over a certain path in the direction of the bolt guide 12, with the damping element 31 damping this displacement. To this end, there is formed in the sleeve-shaped section 16 of the bolt guide 12 a conical inner surface 17 that cooperates with the stop 36 facing in the setting direction which is provided on the stop member 32. With the setting piston 20 striking the stop member 32 with sufficiently high striking energy, the stop 36 is displaced up to the conical surface 17, and the stop member 32 is braked thereby. A further reduction of energy takes places when the piston band 22 of the setting piston is displaced into the bushing 33 in the stop member 32, expanding the bushing 33. It is advantageous when the ratio between the diameter $D_B$ of the piston band 22 and the axial length of the stop member 32 lies in the region of about 2:1. However, ratios of 1:1–3:1 also provide for the expansion or widening of the stop member 32. This expansion is facilitated by a recess 34 which is formed approximately in the middle of the outer surface of the stop member 32. The weakness in the stop member 32, which is caused by the recess 34, acts as a hinge, and the section of the stop member 32 is adjacent to the chamber 14 of the piston guide 13 can be expanded more easily.

In FIG. 2, in which the piston stop device 30 is shown at an increased, in comparison with FIG. 1, scale, the piston stop device 30 does not have any wear. The conical annular surface 24 of the piston band 22 of the setting piston 20 abuts the stop 35 of the stop member 32. The cylindrical bushing 33 is not yet expanded and has essentially the initial diameter $D_S$.

Figure 3:
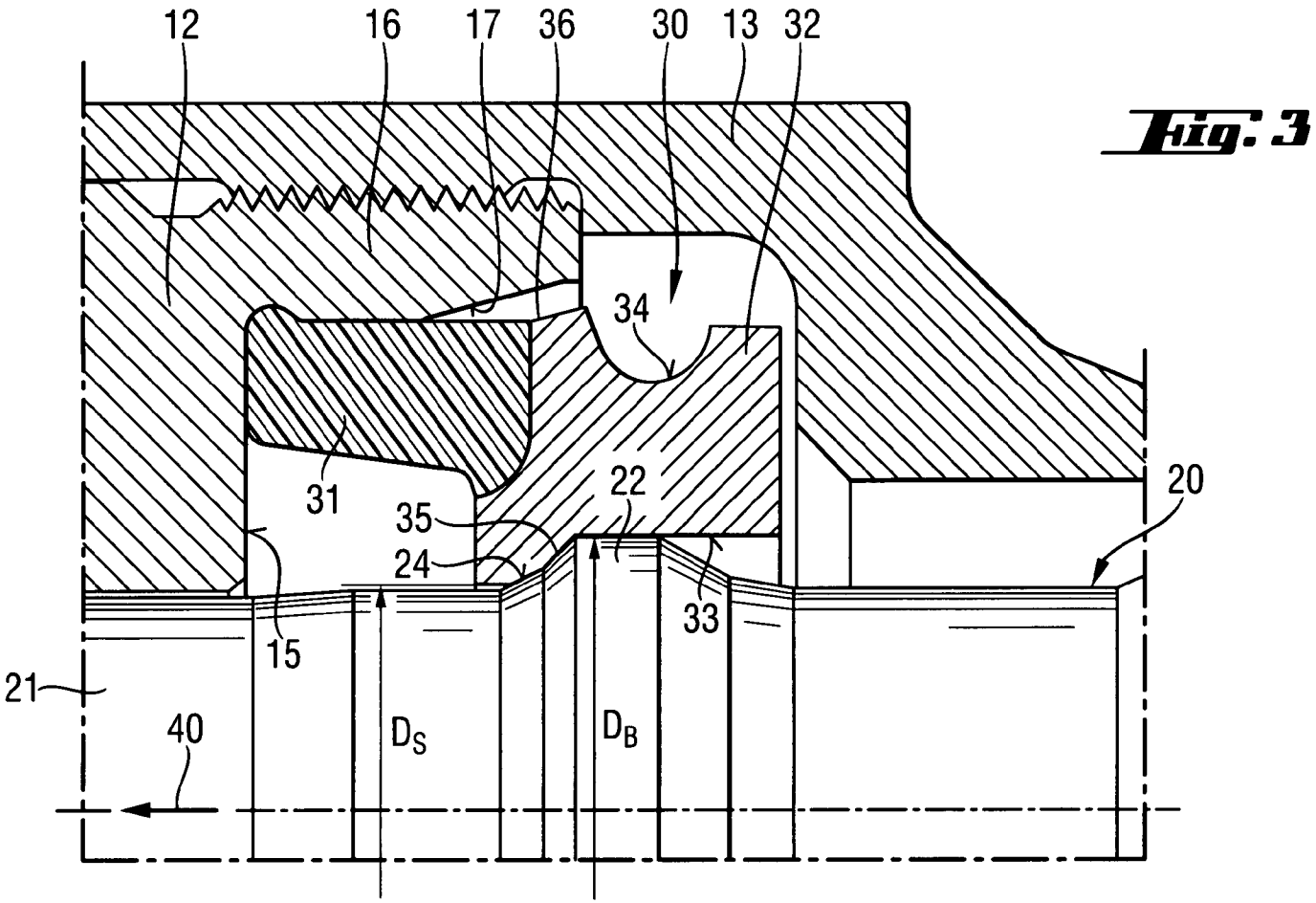
FIG. 3 a view similar to that of FIG. 2 but with the piston stop device having a wear exceeding the allowable wear.

In FIG. 3, the piston stop device 30 is shown in a condition of maximum wear. The setting piston band 22 is located in the busing 33 of the stop member 32 a section of which adjacent to the chamber 14 of the piston guide 13 and has been expanded and reached a diameter corresponding to the diameter $D_B$ of the piston band 22. The inserted position of the piston 20 indicates to the user that the piston stop device 30 and the setting piston 20 should be replaced.

With the inventive stop device 30, in course of testing, thirty false set-ups (at piston energy of 350 Joule) on ten false set-ups (at piston energy of 640 Joule) were conducted until the service life of the stop member has been exceeded, and the setting piston 20 remained stacked in the stop member 32.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A setting tool for driving in fastening elements, comprising:

a piston guide (13) having hollow chamber (14);

a setting piston (20) axially displaceably arranged in the hollow chamber (14) of the piston guide (13) and having a piston head (23), a piston stem (21), and a piston band (22) having a maximal outer diameter (DB); and a piston stop device (30) for the setting piston (20) and arranged in a setting direction end region of the hollow chamber (14), the piston stop device (30) having a damping element (31) supported against a stop (15), and a stop member (32) adjoining the damping element (31) in a direction of the hollow chamber (14) and operationally connectable with the piston band (22), the stop member (32) having a cylindrical bushing (33) for the piston stem (21), the bushing (33) having an inner diameter (DS) that amounts to from 70% to 90% of a size of the maximal outer diameter (DB) of the piston band, the piston band (22) having a conical surface (24) engageable with inner surface of the bushing (33), wherein the piston band (22) has a hardness from 50 to 60 HRC, and the stop member (32) has a hardness in a range from 50% to 70% of the hardness of the piston band (22) with an upper limit of 38 HRC.

2. A setting tool according to claim 1, wherein the stop member (32) and at least the piston band (22) are formed of metal.

3. A setting tool according to claim 1, wherein the stop member (32) has a circumferential recess (34) with an arc-shaped profile.

4. A setting tool according to claim 1, wherein a ratio of a mass of the setting piston (20) to a mass of the stop member (32) varies in a range from 3:1 to 5:1.

5. A setting tool according to claim 1, further comprising a bolt guide (12) adjoining the piston guide (13) at a setting direction end of the piston guide (13) and, having, region-wise, a sleeve-shaped section (16) surrounding, at least partially, the stop member (32) and having an inner surface (17) conically tapering in a setting direction (40) of the setting tool (10).

* * * * *